US005715319A

United States Patent [19]

Chu

[11] Patent Number: 5,715,319

[45] Date of Patent: Feb. 3, 1998

[54] METHOD AND APPARATUS FOR STEERABLE AND ENDFIRE SUPERDIRECTIVE MICROPHONE ARRAYS WITH REDUCED ANALOG-TO-DIGITAL CONVERTER AND COMPUTATIONAL REQUIREMENTS

[75] Inventor: Peter L. Chu, Lexington, Mass.

[73] Assignee: PictureTel Corporation, Andover, Mass.

[21] Appl. No.: 657,636

[22] Filed: May 30, 1996

[51] Int. Cl.[6] ..... H04R 5/027

[52] U.S. Cl. ..... 381/26; 381/68.1; 381/92

[58] Field of Search ..... 381/92, 94, 26, 381/68.1; 367/119, 121, 123, 125, 124, 126

[56] References Cited

U.S. PATENT DOCUMENTS

| | | | |
|---|---|---|---|
| 4,466,067 | 8/1984 | Fontana . | |
| 4,589,137 | 5/1986 | Miller . | |
| 4,955,003 | 9/1990 | Goldman . | |
| 5,058,170 | 10/1991 | Kanamori et al. . | |
| 5,263,019 | 11/1993 | Chu | 370/32.1 |
| 5,305,307 | 4/1994 | Chu | 370/32.1 |

OTHER PUBLICATIONS

J. Kates, "Superdirective Arrays for Hearing Aids", *J. Acoust. Soc. Am.*, vol. 94(4), pp. 1930–1933.

H. Cox et al., "Practical Supergain", *IEEE Trans. Acoust., Speech, Signal Processing*, vol. ASSP–34, pp. 393–398, Jun. 1986.

H. Cox et al., "Robust Adaptive Beamforming", *IEEE Trans. Acoust., Speech, Signal Processing*, vol. ASSP–35, pp. 1365–1376, Oct. 1987.

J. Kates, "An Evaluation of Hearing–Air Array Processing", *1995 IEEE ASSP, Workshop on Applications of Signal Processing to Audio and Acoustics*, New Paltz, New York.

J.E. Hudson, *Adaptive Array Principles*, pp. 69–69, copyright 1981, New York: Peter Peregrinus for IEE.

Walter Kellermann, "A Self–Steering Digital Microphone Array", IEEE Proc. Int. Conf. Acoustics, Speech & Signal Processing, pp. 3581–3584, May 1991.

M.M. Goodwin et al., "Constant Beamwidth Beamforming", IEEE Proc. Int. Conf. Acoustics, Speech & Signal Processing, pp. 169–172, Apr. 1993.

*Primary Examiner*—Forester W. Isen

*Attorney, Agent, or Firm*—Fish & Richardson P.C.

[57] ABSTRACT

An end fire microphone array having reduced analog-to-digital converter requirements is disclosed. Analog filters are used to band-limit at least two secondary microphone elements which are spaced from a primary microphone element a distance respective of their band limited outputs. The band-limited secondary microphone outputs are combined by an analog summer and the primary microphone and combined secondary microphone signals are digitized by an analog-to-digital converter. A signal processor performs a super-directive analysis of the primary microphone signal and the combined secondary microphone signals.

A steerable superdirective microphone array is disclosed. A plurality of microphones are arranged in a ring. The microphone outputs are digitized, split into frequency bands, and weighted sums are formed for each of a plurality of directions. A steering control circuit evaluates the relative energy of each directional signal in each band and selects a microphone direction for further processing and output.

25 Claims, 6 Drawing Sheets

METHOD AND APPARATUS FOR STEERABLE AND ENDFIRE SUPERDIRECTIVE MICROPHONE ARRAYS WITH REDUCED ANALOG-TO-DIGITAL CONVERTER AND COMPUTATIONAL REQUIREMENTS

BACKGROUND OF THE INVENTION

The invention relates generally to the fields of microphones and signal enhancement of microphone signals and more specifically to the field of teleconferencing microphone systems.

Noise and reverberance have been persistent problems plaguing teleconferencing systems where several people are seated around a table, typically in an acoustically live room, each shuffling papers. Prior methods of signal enhancement have focused on noise reduction and reverberance cancelling techniques.

Superdirective arrays and methods have been used extensively in radio frequency and sonar applications. See e.g., J. E. Hudson, *Adaptive Array Principles*, pp. 59–69, copyright 1981, New York: Peter Peregrinis for IEE. Early application of superdirectivity to acoustic pickup was described in J. Kates, "Superdirective Arrays for Hearing Aids", *J. Acoust. Soc. Am.*, vol. 94(4), pp. 1930–1933 and experimental results with a 32 band system were reported in J. Kates, "An evaluation of Hearing-Aid Processing", 1995 *IEEE ASSP Workshop on Applications of Signal Processing to Audio and Acoustics*, New Paltz, N.Y. The basic principles of superdirectivity are well explained in H. Cox et al., "Practical Supergain", *IEEE Trans. Acoust., Speech, Signal Processing*, vol. ASSP-34, pp. 393–398, June 1986 and in H. Cox, et al., "Robust Adaptive Beamforming", *IEEE Trans. Acoust., Speech, Signal Processing*, vol. ASSP-35, pp. 1365–1376, October 1987.

Efforts to maintain the constancy of the beamwidth over broad frequency ranges are discussed in M. M. Goodwin et al., "Constant Beamwidth Beamforming", *IEEE Proc. Int. Conf. Acoustics, Speech & Signal Processing*, pp. 169–172, April 1993, and efforts to make a self steering microphone array are discussed in W. Kellerman, "A self-Steering Digital Microphone Array", *IEEE Proc. Int. Conf. Acoustics, Speech & Signal Processing*, pp. 3581–3584, May 1991.

SUMMARY OF THE INVENTION

A directional microphone array in accordance with one aspect of the present invention includes a primary microphone connected to a first analog-to-digital converter and two or more secondary microphones arranged in line with and spaced predetermined distances from the primary microphone. The two or more secondary microphones are each frequency filtered with the response of each secondary microphone being limited to a predetermined band of frequencies respective of the relative placement of the respective secondary microphone. The frequency filtered secondary microphone outputs are combined and input to a second analog-to-digital converter.

Preferred embodiments may also include a signal processor connected to the outputs of the analog-to-digital converters to receive the primary microphone signal and the combined secondary microphone signals. The signal processor may divide the primary and secondary signals into a plurality of frequency bands, apply weighting to the primary and secondary signals in each band and combine the primary and secondary weighted signals in each band. A synthesizer for each band may be provided to convert the combined signals from each band into a band limited output. The outputs from each synthesizer may be combined to provide a directional microphone output.

Preferred embodiments may also include a signal processor to perform echo cancellation, noise suppression, automatic gain control, or speech compression on the combined signals from each band prior to synthesis.

A steerable superdirective microphone array in accordance with another aspect of the present invention includes a first and a second microphone each having a forward directional response and a rearward directional response. The rearward directional response has a predetermined relationship to the forward directional response. The first and second microphones are arranged having their respective responses aligned to a predetermined axis. An analog-to-digital converter connected to receive signals from the first and second microphones produces digital signals representative of the microphone signals. A signal processor receives and splits each of the digital signals into a plurality of predetermined frequency bands respectively generating a first microphone signal and a second microphone signal for each of the predetermined frequency bands. The first and second microphone signals in each band are each weighted for a forward direction and a reverse direction. The first and second forward weighted signals in each band are combined to form a forward signal in each band and the first and second rearward weighted signals in each band are combined to form a rearward signal in each band. A direction controller receives the forward and rearward signals in each band and selects a direction representative of the source direction according to predetermined criteria. The signals in each band from the selected direction are output, steering the direction of the microphone array.

The steerable array may also have a signal processor connected to receive the signals in each band from the selected direction and perform echo cancellation, noise suppression, automatic gain control, or speech compression on the selected signals. A synthesizer for each band may be provided to convert the processed signals from each band into a band limited output. The outputs from each synthesizer may be combined to provide a steered microphone output.

A steerable superdirective microphone array in accordance with another aspect of the present invention includes a plurality of microphones each having a forward response and a rearward response. The microphones are generally arranged spaced apart in a ring. An analog-to-digital converter connected to receive signals from each one of the plurality of microphones produces a digital signal representative of each microphone signal. A signal processor receives and splits the digital signals representative of each microphone signal into a plurality of predetermined frequency bands. Each microphone signal in each band is weighted for each one of a plurality of predetermined response directions. Separately for each response direction and for each band, the weighted signals from each microphone are combined to form a direction response signal in each band. A direction controller receives the direction response signal in each band and selects a response direction according to predetermined criteria. The direction response signals in each band corresponding to the selected response direction are combined to form an output representative of the steered direction of the microphone array.

The steerable array may also have a signal processor connected to receive the signals in each band corresponding to the selected response direction and perform one or more of a plurality of performance enhancing signal processing functions including echo cancellation, noise suppression, automatic gain control, and speech compression on the selected signals. A synthesizer for each band may be provided to convert the processed signals from each band into a band limited output. The outputs from each synthesizer may be combined to provide a steered microphone output.

A superdirective steerable microphone array in accordance with another aspect of the invention includes a plurality of microphones arranged in an inner ring and an outer ring. Each microphone has a forward and rearward response. The microphones in the inner ring have their individual outputs connected to a respective high pass filter. The microphones in the outer ring have their individual outputs connected to a respective low pass filter. The high pass filter output respective of each individual microphone in the inner ring is combined with a low pass filter output respective of a predetermined microphone in the outer ring. An analog-to-digital converter connected to receive the combined outputs produces a digital signal representative of each combined output. A signal processor receives and splits the digital signals representative of each microphone signal into a plurality of predetermined frequency bands. Each microphone signal in each band is weighted for each one of a plurality of predetermined response directions. Separately for each response direction and for each band, the weighted signals from each microphone are combined to form a direction response signal in each band. A direction controller receives the direction response signal in each band and selects a response direction according to predetermined criteria. The direction response signals in each band corresponding to the selected response direction are combined to form an output representative of the steered direction of the microphone array.

The steerable array may also have a signal processor connected to receive the signals in each band corresponding to the selected response direction and perform one or more of a plurality of performance enhancing signal processing functions including echo cancellation, noise suppression, automatic gain control, and speech compression on the selected signals. A synthesizer for each band may be provided to convert the processed signals from each band into a band limited output. The outputs from each synthesizer may be combined to provide a steered microphone output.

A method for operating a microphone array in accordance with another aspect of the invention includes the steps of receiving digital samples representative of a plurality of spaced apart microphones. Separately for each microphone, a group of samples is collected and converted into frequency domain signals comprising a plurality of frequency bands. Separately for each of the frequency bands, the frequency domain signals are weighted and combined to form one or more directional signals. A selected one of the one or more directional signals is converted to time domain signals which are provided as an output.

Preferred embodiments may also include the steps of separately for each frequency band evaluating the energy of each of the one or more directional signals and selecting for output the directional signal satisfying a predetermined criteria. Echo cancellation, noise suppression, automatic gain control, and speech compression methods may also be included and performed on the selected directional signal.

A signal processor in accordance with another aspect of the present invention includes an input for receiving microphone signals from a plurality of spaced apart microphones. A frequency filter connected to the input receives the microphone signals and produces a plurality of narrow band signals respective of each one of the microphones as an output. A weighting and summing processor connected to the frequency filter output forms a plurality of narrow band directional signals respective of two or more directions as an output. A steering processor connected to the weighting and summing processor receives and evaluates the energy of the narrow band directional signals and selects an output direction according to predetermined criteria. An output processor generates a full band directional output respective of the output direction.

Preferred embodiments may include a signal enhancer connected between the weighting and summing processor and the output processor for performing at least one process for echo cancellation, noise suppression, automatic gain control, or speech compression. In preferred embodiments, the steering processor may determine the direction whose energy in the bands is both greater than the energy of the remaining directions and greater than a predetermined threshold for a greater number of the bands than the remaining directions and the number exceeds a predetermined number. Alternatively, a previous direction may be selected when none of the directions exceeds the predetermined number.

DESCRIPTION OF THE PREFERRED EMBODIMENTS

Figure 1:
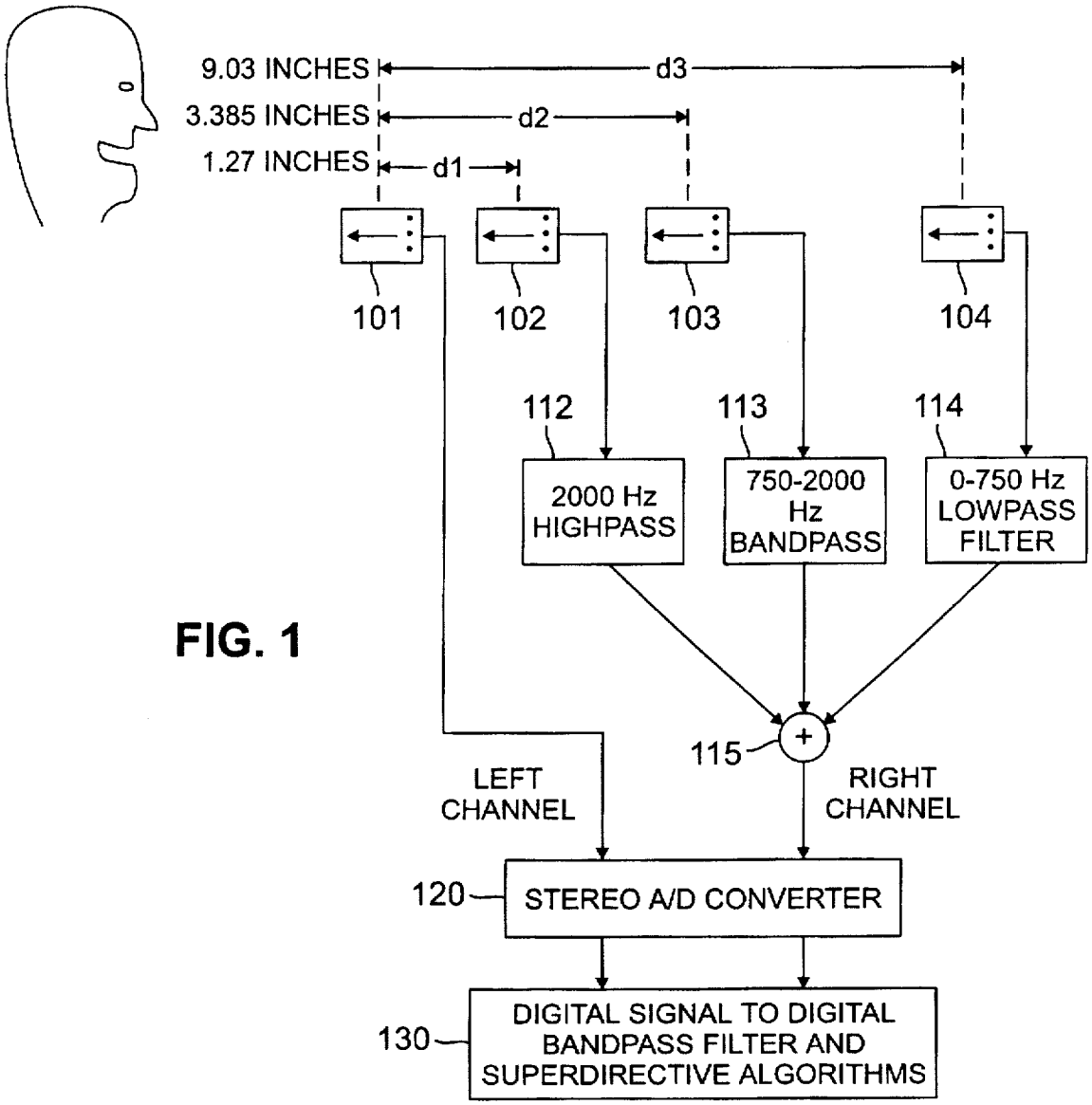
FIG. 1 is a block diagram of a superdirectional end-fire microphone array with reduced analog-to-digital converter requirements.

Referring to FIG. 1, an endfire superdirective microphone array with reduced analog-to-digital converter and signal processing requirements in accordance with one aspect of the present invention will be described. Four cardioid microphones 101, 102, 103, and 104 arranged in-line form the elements of an endfire superdirective array. Second element microphones 102, 103, and 104 are spaced a respective fixed distance d1, d2, and d3 from first element microphone 101. The output of each second element microphone 102, 103, and 104 is band limited to a frequency range respective of its spacing from microphone 101.

For maximum gain, each second element microphone should be ideally spaced ¼ wavelength from the first element microphone. A precise wavelength spacing cannot be satisfied for all frequencies because each second element microphone is responsive to a range of frequencies. The increased performance obtained by additional microphones and narrower frequency bands is offset by the additional cost of the added components. Good performance may be obtained spacing each second element microphone between ⅛th and ½ wavelength from the first element microphone.

In the example of FIG. 1, the audio spectrum is divided into three bands, 0–750 Hz, 750–2000 Hz and greater than 2 KHz. To ensure that the second element microphone spacing from the first element does not exceed ½ wavelength, the highest frequency in the band may be used to determine the spacing. In the example of FIG. 1, microphone 104 is filtered by lowpass filter 114 which has a high frequency cutoff of 750 Hz. Microphone 104 is therefore spaced one half of the 750 Hz wavelength from first element microphone 101. The wavelength of a 750 Hz acoustical signal in air is approximately 18.05 inches, thus microphone 104 is spaced 9.03 inches from microphone 101. Similarly, microphone 103 is filtered by 750–2000 Hz bandpass filter 113 and accordingly spaced 3.385 inches from microphone 101 corresponding to its 2 KHz cutoff. Microphone 102 is filtered by high pass filter 112 having a low frequency cutoff of 2 KHz. Microphone 102 is spaced 1.27 inches from microphone 101 which provides the ideal ¼ wavelength spacing at a frequency of 2.7 KHz and the worst case ½ wavelength spacing at a frequency of 5.3 KHz.

The three filter outputs are combined at node 115 and converted to digital values by the right channel of a stereo analog-to-digital converter ("A/D") 120. The full bandwidth signals from microphone 101 are converted to digital values by the left channel of A/D 120. A/D 120 further includes an anti-aliasing filter on each input (not shown). The outputs of A/D 120 are fed to a digital signal processor ("DSP") 130. DSP 130 performs the superdirective optimization methods as described in more detail below with reference to FIG. 3.

In the configuration of FIG. 1, microphones 104 and 101 form a two-element superdirective array for the low frequency signals (0–750 Hz). Similarly, microphone pairs 103 and 101 and 102 and 101 respectively form two-element superdirective arrays for the mid-band (750–2000 Hz) and high-band (>2000 Hz) signals. The array of FIG. 1 thus appears as a two-element array whose apparent inter element spacing increases with decreasing frequency. The broad band signal-to-noise ratio performance provided by the array of FIG. 1 is improved over conventional two-element arrays. However, the cost of a three or more element array is avoided by using a single A/D channel for all of the second element microphones. DSP 130 need analyze only 2 channels of data rather than one channel for each microphone thus further reducing costs compared to a three-or-more element array.

Figure 3:
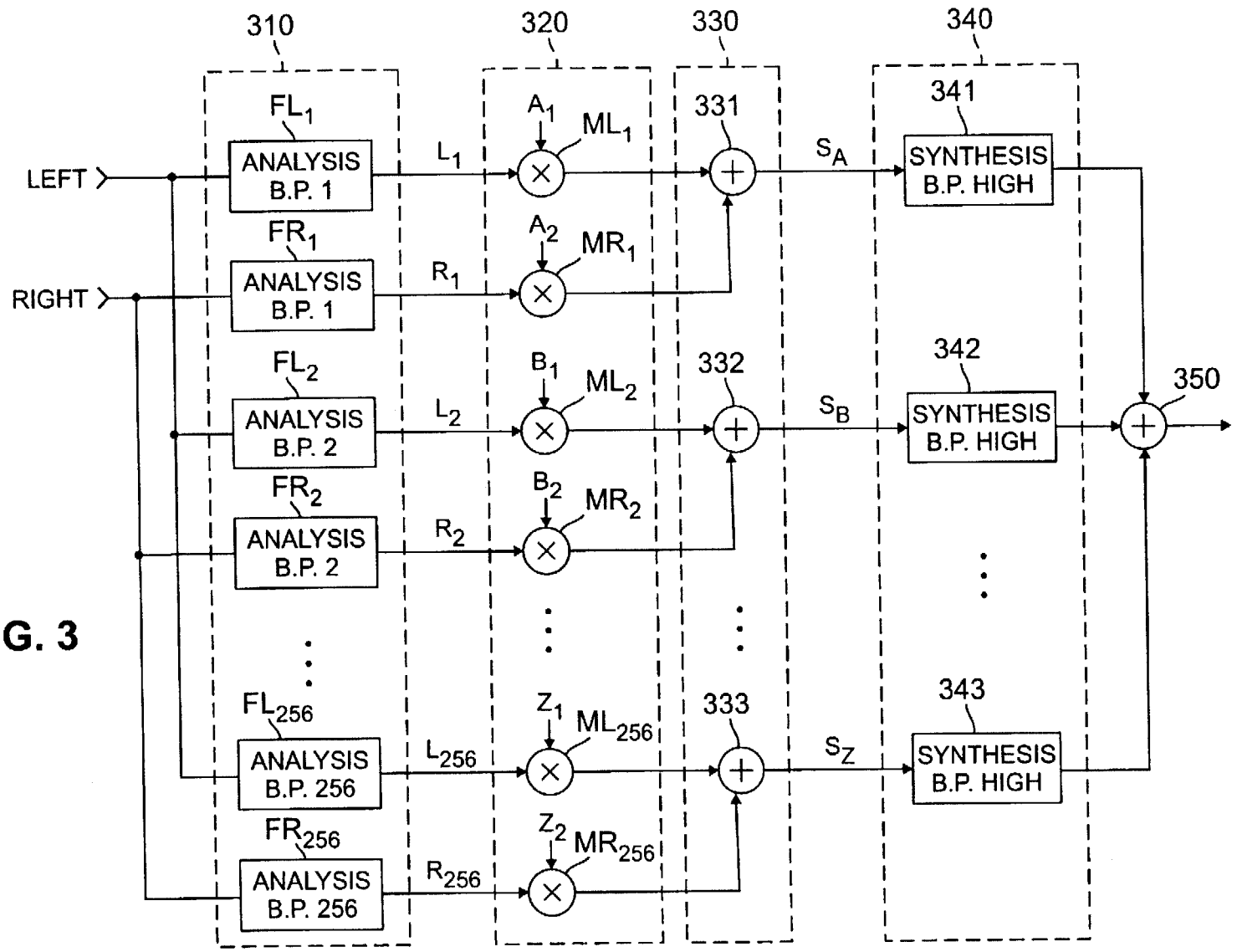
FIG. 3 is a functional block diagram of a signal processing method for the superdirectional end-fire microphone array of FIG. 1.

A functional block diagram of the signal processing performed by digital signal processor 130 is provided in FIG. 3. A filter bank 310 comprising several bandpass filters splits up each full band microphone signal into a plurality of narrow band signals. The narrow band signals typically have a bandwidth less than one third of their center frequency. The output of each bandpass filter also may be downsampled. In the example of FIG. 3, several bandpass filters 310 are shown for each of the two microphone channels. The signals from microphone 101, connected to the left channel, are split by filters $FL_1$, $FL_2$, . . . $FL_{256}$ into narrow band signals $L_1, L_2, \ldots L_{256}$. The signals from the second element microphones 102, 103, 104 connected to the right channel are split by filters $FR_1$, $FR_2$, . . . $FR_{256}$ into narrow band signals $R_1, R_2, \ldots R_{256}$.

Preferably, a Fast Fourier Transform is used to perform the narrow band analysis of filters 310. In a preferred embodiment, a 512 point FFT is performed on a group of 512 samples from each A/D channel thereby splitting each full band signal into 256 frequency bands. The A/D 120 of FIG. 1 may be operated at a sample rate of 16 KHz yielding 256 frequency bands of 31.25 Hz width in the range of 0 to 8 KHz. When 2× oversampling is used, an FFT is performed every 16 milliseconds for each channel.

Separately for each frequency band, the microphone signals are linearly combined together with complex weights chosen to maximize the signal-to-noise ratio resulting in that band from the linear combination. The well known general solution for the optimal tap weights in an N element endfire superdirective array is provided in equation 1 below.

$$a = \frac{Q^{-1}d}{d * Q^{-1}d} \tag{1}$$

In equation 1, d is a column vector composed of complex numbers corresponding to the amplitudes and phases of the source signal as it hits the N microphone elements, Q is the N by N noise complex cross-spectral correlation matrix giving the noise cross-correlation between the N elements, and a is the resulting column vector of the N complex tap weights (for example, $A_1$, $A_2$ in FIG. 1) for the optimal linear combination of the N microphone signals in a particular band that results in the maximum signal-to-noise ratio for that band. For the array in FIG. 1 which analytically is a two-element array, N is 2. In practice, the m, n entry for Q may be estimated by finding the dot product of a sequence of complex noise samples from microphone element m with a sequence of time-synchronous complex noise samples from microphone element n for the same band. Intuitively, the solution of equation 1 for the weights may be viewed as a multidimensional extension of the classical one dimensional solution of a whitening filter followed by a matched filter to maximize the signal-to-noise ratio.

The procedure for estimating the cross-spectral correlation matrix must be based on data which doesn't contain signal. It is desirable for the matrix to be continuously recalculated along with the resulting taps since the noise may change, for example, an overhead projector or air conditioner may be powered on or off. As described in copending application Ser. No. 08/402,550 entitled "Reduction Of Background Noise For Speech Enhancement" filed Mar. 13, 1995 and commonly assigned, a stationary detector may be used to detect when the signal is constant in both energy and spectrum. If the signal is constant for long enough, 2 seconds, typically, that data is used to find the cross-spectral correlation matrix and the weights are calculated.

The procedure for estimating the signal vector, d, involves putting the microphone array in an anechoic chamber, putting a white noise source in the far-field at the bearing angle that the assumed source will be present at, and then, in each band, measuring the magnitude and phase differences as the signal hits the microphone elements. The assumed source for the microphone arrays of FIGS. 1 and 2 is located on an axis passing through the four microphones and at the end closest to first element microphone 101.

As shown in FIG. 3, the left and right channel narrow band signals for each band, $L_1$, $R_1$ for example, are weighted by multipliers 320, $ML_1$, $MR_1$ for example, using complex tap weights $A_1$, $A_2$ for example, respectively. The sum of the weighted narrow band signals is found for each frequency band by adders 330, 331 for example, to produce the optimized narrow band signals, $S_A$ for example. The optimized narrow band signal for each frequency band is synthesized into time domain signals and bandpass filtered, and then combined by a summer 350 to form the microphone array output. Preferably, an inverse FFT followed by a window function is performed on the optimized narrow band signals to form the microphone array output.

Alternatively, various signal enhancement processes may be incorporated in the signal processor. For example, echo cancellation, noise suppression, automatic gain control, and speech compression may be performed on the optimized narrow band signals before the inverse FFT is performed thereby avoiding the added computational requirements and delay of a second bandpass analysis. Echo cancellation is disclosed in U.S. Pat. No. 5,305,307 entitled "Adaptive Acoustic Echo Canceller Having Means for Reducing or Eliminating Echo in a Plurality of Signal Bandwidths" and in U.S. Pat. No. 5,263,019, entitled "Method and Apparatus for Estimating the Level of Acoustic Feedback Between a Loudspeaker and Microphone"; noise suppression is disclosed in copending application Ser. No. 08/402,550, entitled "Reduction Of Background Noise for Speech Enhancement", filed on Mar. 13, 1995; automatic gain control is disclosed in copending application Ser. No. 08/434,798, entitled "Voice-Activated Automatic Gain Control", filed on May 4, 1995; and speech compression is disclosed in U.S. Pat. No. 5,317,672 entitled "Variable Bit Rate Speech Encoder"; all of which are commonly assigned with the present application.

Figure 2:
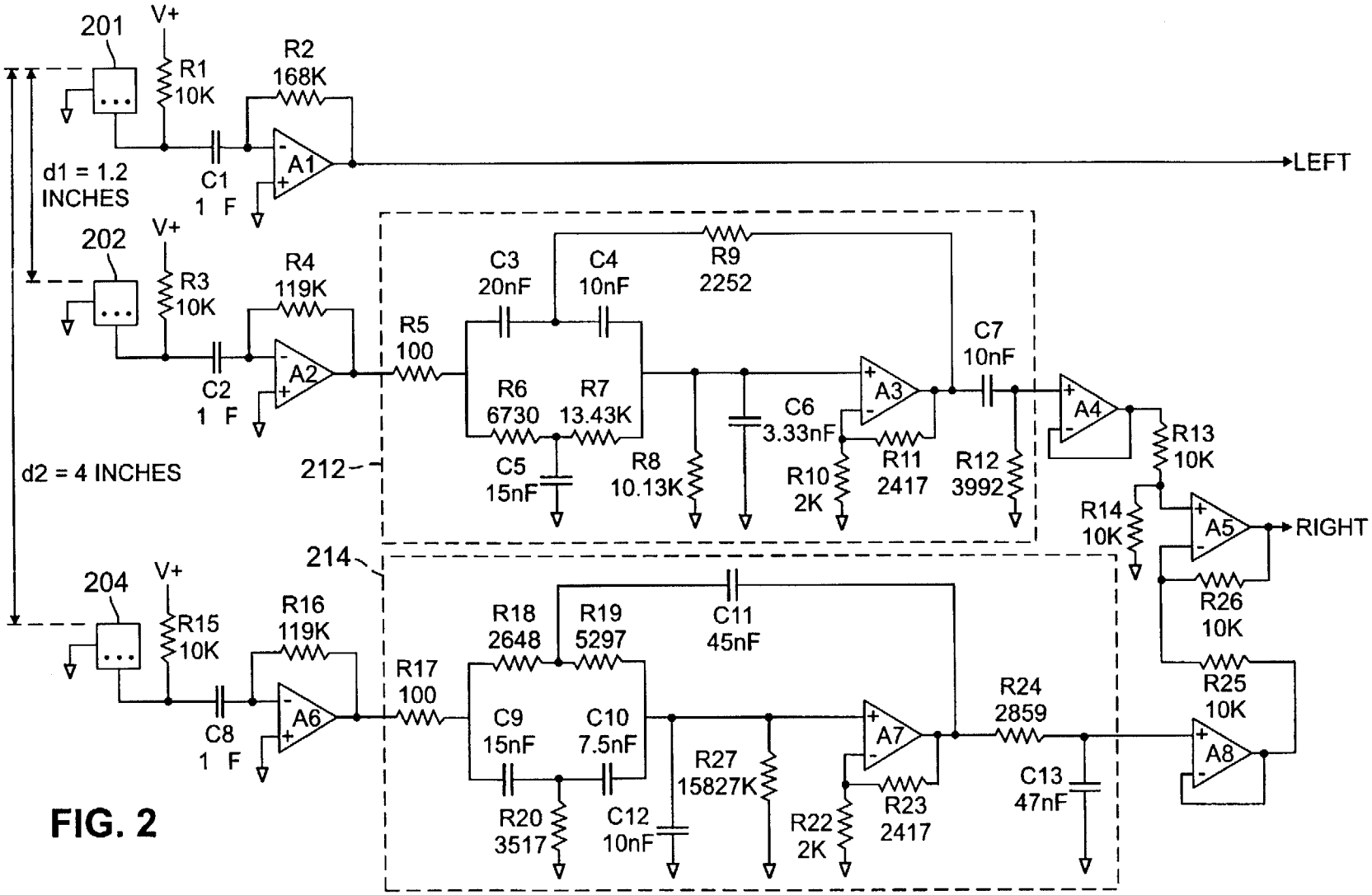
FIG. 2 is a schematic diagram of a two band analog filter circuit suitable for use in a superdirectional end-fire microphone array with reduced analog-to-digital converter requirements.

Referring to FIG. 2, the analog circuitry for a three microphone prototype embodiment of the invention is shown. Microphones 201 and 202 form the two-element array for frequencies above 2.368 KHz and microphones 204 and 201 form the two-element array for frequencies below 2 KHz. Low pass filter 214 and high pass filter 212 band limit microphones 204 and 202 respectively. The filter outputs are combined by amplifier A5 and fed to the right channel of a stereo analog-to-digital converter (not shown). As in the example of FIG. 1, the full band signal from the first element (front) microphone 201 is amplified and fed to the left channel of the analog-to-digital converter.

Alternative embodiments may include additional groups of bandpassed microphones spaced, frequency filtered, and connected as third, fourth, etc. elements in a three, four, etc. element superdirective array.

Steerable Superdirective Array

Figure 4:
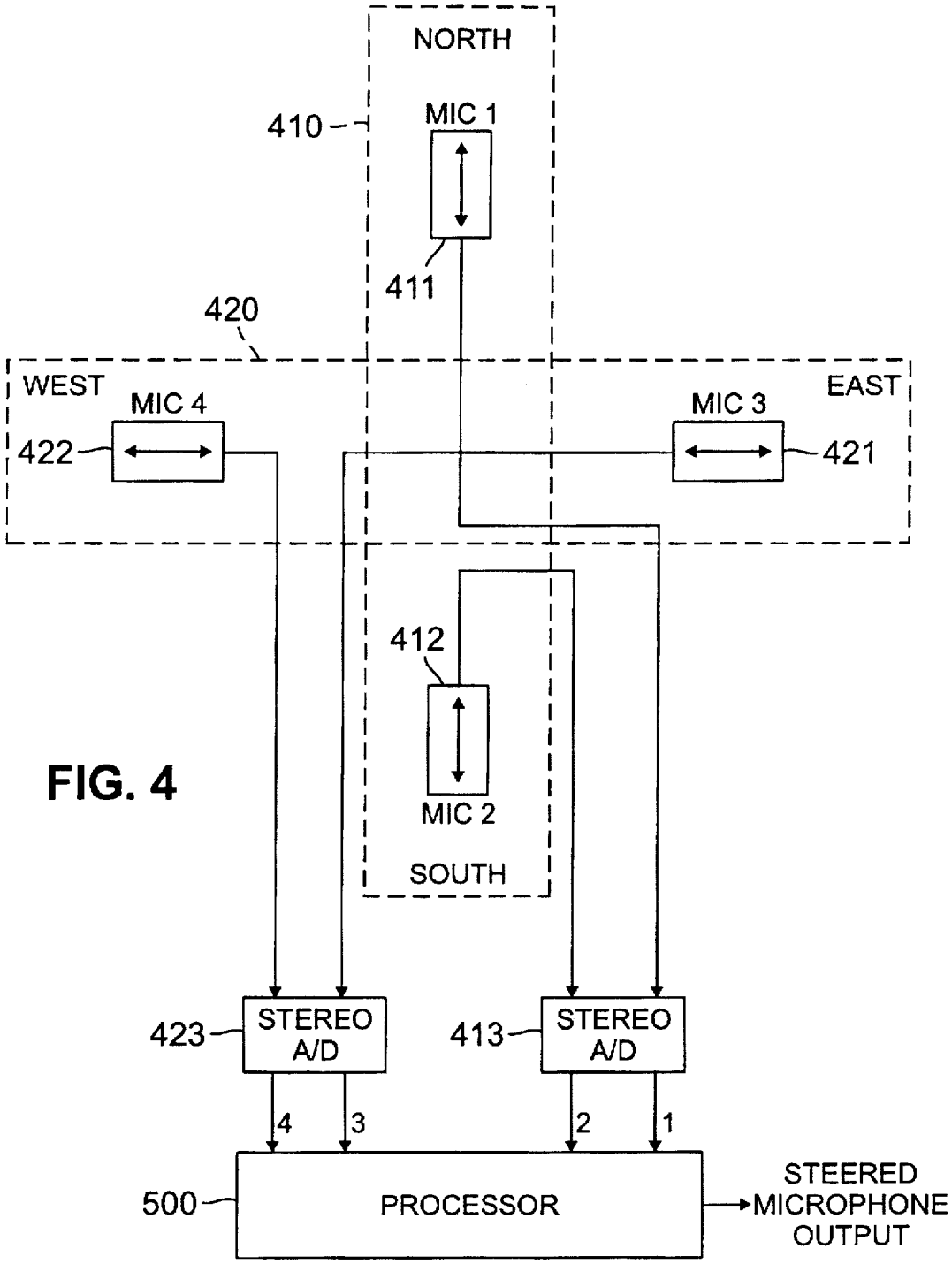
FIG. 4 is a functional block diagram of a steerable superdirectional end-fire microphone array.

A four microphone steerable superdirective microphone array is shown in FIG. 4. Dipole microphones 411 (MIC 1), 412 (MIC 2), 421 (MIC 3), and 422 (MIC 4) each have a figure eight bidirectional response characteristic. Array 410 comprising microphones 411 and 412 is a two element endfire array providing superdirective gain in the north and south directions. Similarly, microphones 421 and 422 form a two element endfire array 420 providing superdirective gain in the east and west directions. An additional four directions of superdirective gain may be obtained by summing the microphone outputs to form virtual dipoles. For example, a virtual dipole microphone on the northeast axis is obtained by adding the outputs of microphones 411 and 421. A two element endfire array in the northeast and southwest directions comprises as a first element the virtual dipole formed by combining microphones 411 and 421 and as a second element the virtual dipole formed by combining microphones 412 and 422. Similarly, microphones 411 and 422 and microphones 412 and 421 may be combined to form a virtual endfire array in the northwest and southeast directions. Methods for combining and analyzing the microphone outputs will be discussed in greater detail below. It is sufficient to state here that for well matched microphones, the outputs of the microphones may be added together to form the virtual dipole signals. However, complex weights are preferably derived for each direction as is described below.

Each microphone output is fed to one channel of a stereo A/D converter yielding four channels of digital samples. Preferably, the A/D converters operate at a 16 KHz sampling rate and are provided with internal anti-aliasing filters. Digital signal processor 500 performs the superdirective analysis and signal enhancement in a manner similar to that described above in connection with FIG. 3. Directional control of the microphone array is also performed by DSP 500 as will be described in greater detail below. In a preferred embodiment, a TMS320C31 digital signal processor chip available from Texas Instruments Inc. is used for the DSP 500.

Figure 5:
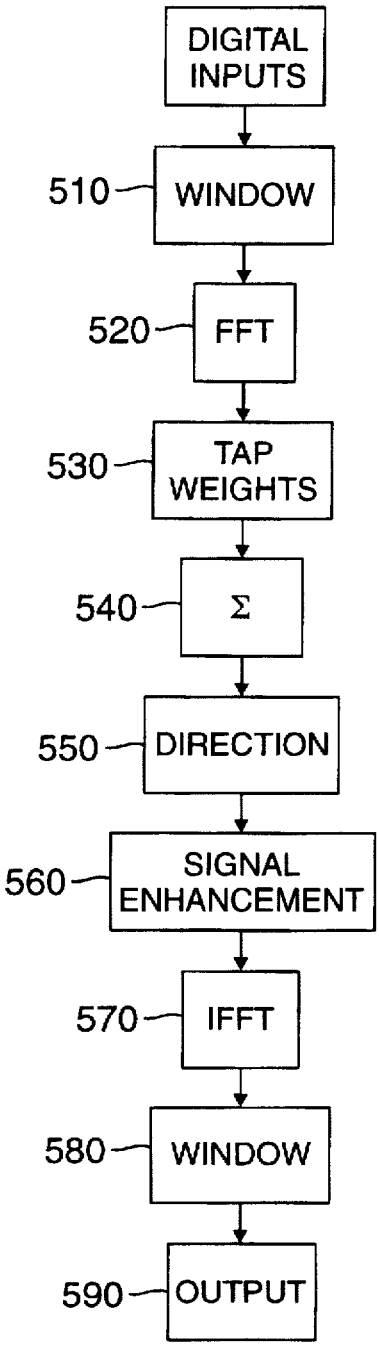
FIG. 5 is a functional block diagram of a signal processing method suitable for use with the steerable superdirectional microphone array of FIG. 4.

A functional block diagram of the process steps performed by processor 500 is provided in FIG. 5. The four channel A/D digital outputs are received by DSP 500 which performs a windowing function 510 on each channel. A Hamming Window with 50% overlap is preferred, but any other suitable window function may be used, to collect the data samples from the A/D converters for FFT processing.

An FFT process 520 in FIG. 5 is performed on the windowed data from each channel. Preferably a 512 point FFT is used yielding 256 frequency bands which may be numbered 1 through 256. The FFT function block yields complex values for each of the four A/D channels in each of the 256 frequency bands. Using MIC 1 as an example, the FFT results will yield a complex MIC 1 value in each of the 256 frequency bands which may be numbered 1 through 256.

The FFT results are multiplied by tap weights in function block 530. The general solution for the optimal tap weights is discussed above in connection with FIG. 3. In the case of the steerable superdirective array of FIG. 4 however, the signal vector d is measured for each of the eight directions. To support eight steerable directions for the microphone array of FIG. 4, eight complex tap weights are used for each of the four A/D channels in each of the 256 frequency bands. Thus, eight weighted directional signals from each of the four microphones is calculated in each of the 256 frequency bands in function block 530. Using MIC 1 and frequency band 1 as an example, a MIC 1 north, northeast, east, southeast, south, southwest, west, and northwest value in frequency band 1 is calculated by multiplying the MIC 1 value for frequency band 1 by eight directional tap weights respective of frequency band 1.

The summing block 540 in FIG. 5 represents derivation of the eight directional signals in each of the 256 frequency bands. The respective weighted directional signals from each microphone in each band are summed to form the directional signals. For example, the weighted northeast signals from each of the four microphones in frequency band 1 are summed to form the northeast directional signal in frequency band 1. Similar sums are calculated for each of the eight directions in each of the 256 frequency bands.

Directional control block 550 selects one of the eight directions for output by the steerable array. To do this, the running peak energy for each of the eight directions in each of the 256 frequency bands is calculated in accordance with equation 2.

$$P(k,d)=|x(k,d)|^2 \text{ if } |x(,k,d)|^2>P(k,d) \text{ else } P(k,d)=0.94P(k,d) \qquad (2)$$

In equation 2, k indexes the frequency band (1-256), d indexes the direction (1-8), and x(k,d) is the subsampled, weighted-sum result for frequency band k, and direction d.

The direction yielding the maximum P(k,d) is found for each frequency band. In each frequency band that the maximum P(k,d) exceeds the noise floor by a predefined threshold, 10 dB for example, it is counted as a vote for that direction. In frequency bands where the maximum P(k,d) does not exceed the threshold, no direction receives a vote. After all the bands are tallied, the direction which received the greatest number of votes is selected for output during the current sample provided that the number of votes is greater than a predetermined minimum, for example, seven, indicating that the signal is significantly stronger than the noise. If the minimum number of votes is not satisfied, the direction selected in the previous sample is again selected for output during the current sample. The 256 frequency bands from the selected direction are used to generate the array output as described above in connection with FIG. 3. For example, the subsampled, weighted-sum results for each of the frequency bands for the selected direction may be enhanced 560, synthesized 570, summed, windowed 580, and output 590 as shown in FIG. 5.

Figure 6:
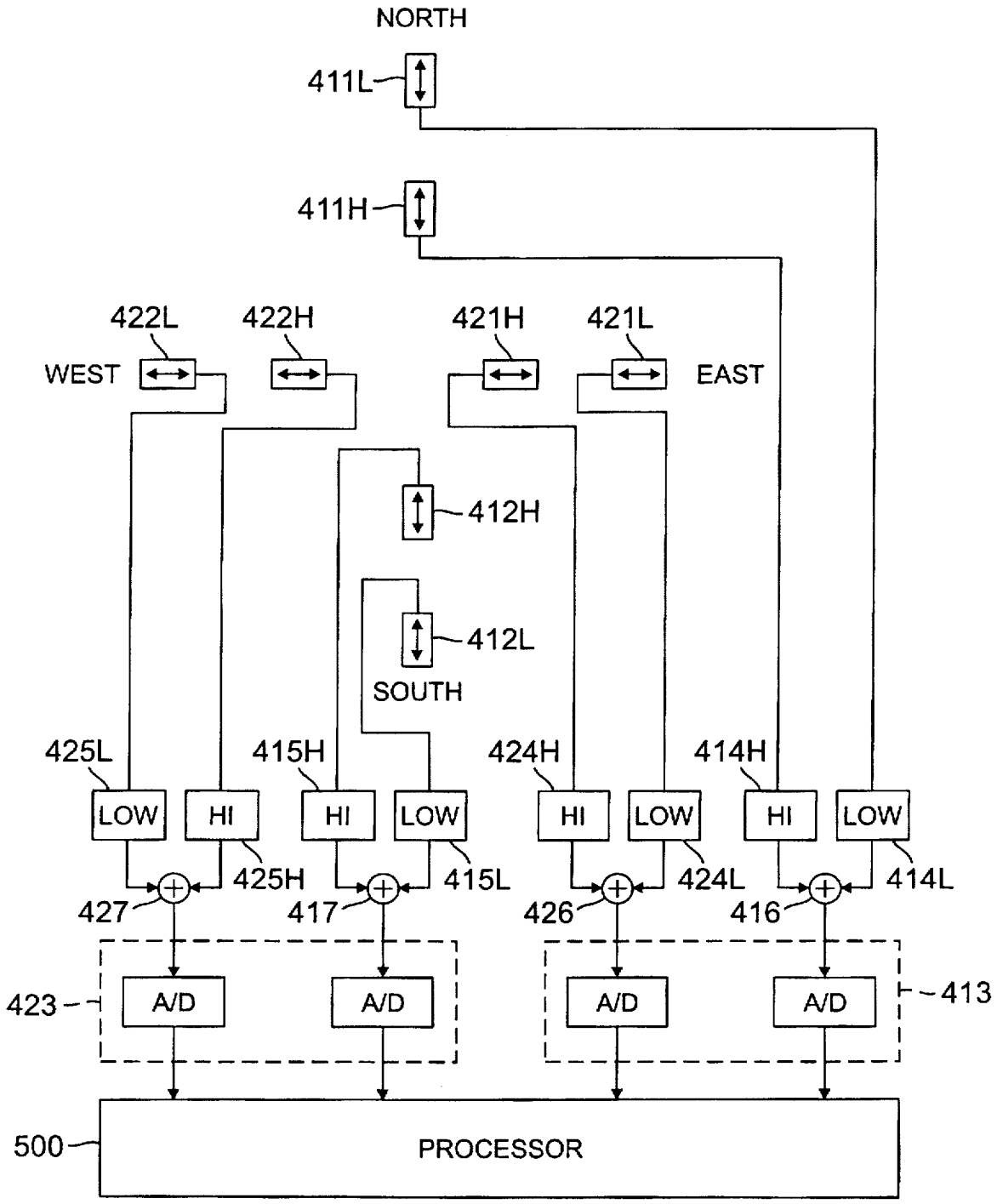
FIG. 6 is a functional block diagram of a steerable superdirectional end-fire microphone array with reduced analog-to-digital converter requirements.

Another embodiment of a steerable microphone array with an enhanced signal-to-noise ratio over a broader range of frequencies in accordance with the invention is shown in FIG. 6. Two rings of microphones are provided, an inner ring comprising microphones 411H, 421H, 412H, and 422H and an outer ring comprising microphones 411L, 421L, 412L, and 422L. For convenience the inner ring may be called the H ring and the outer ring may be called the L ring.

Each of the microphone rings H, L function the same as the single ring of microphones described in connection with FIG. 4. However, each microphone in the inner ring is band limited to high frequencies and each microphone in the outer ring is band limited to low frequencies. Using the north and south directions as an example, microphones 411L and 412L form a superdirectional two-element endfire array for low frequencies. Similarly, microphones 411H and 412H form a superdirectional two-element endfire array for high frequencies in those directions.

Filters 414H, 424H, 415H, and 425H respectively limit the frequency response of microphones 411H, 421H, 412H, and 422H to a high frequency range appropriate their spacing as described above in connection with FIG. 1. Similarly, filters 414L, 424L, 415L, and 415L respectively limit the frequency response of microphones 411L, 421L, 412L, and 422L to a low frequency range appropriate to their spacing. The outputs of filters 414H and 414L are summed at node 416 and fed to input of a stereo A/D converter 413. Similarly, the outputs of filters 424H and 424L, 415H and 415L, and 425H and 425L are respectively summed at nodes 426, 417, and 427 and fed to a respective input of stereo A/D converter 413 and 423.

Digital signal processor 500 performs the superdirective, signal enhancement, and steering processes described above in connection with FIG. 5. Using the combined outputs of two rings of band-limited microphones provides an enhanced signal-to-noise ratio in the superdirective array because the apparent spacing of the real and virtual elements in the array relative to each other increases with decreasing frequency. The computation requirements of the DSP 500 is not increased despite the increased performance. Additional microphones may be provided for the virtual directions (northeast, southeast, southwest, northwest) in the outer rings to improve performance.

In an alternate embodiment a microphone (or two) may be oriented on an axis perpendicular to the response plane formed by the ring of microphones in FIG. 4 (or FIG. 6) to provide additional directional control. Nine additional directions, one vertical and eight at forty five degrees from vertical in each of the eight horizontal directions may be provided by adding one additional axis. The computational requirements increase for each added direction however.

From the foregoing description it will be apparent that improvements in teleconferencing microphone and microphone array apparatus and methods have been provided to improve the performance with minimal additional hardware requirements. While preferred embodiments have been described, it will be appreciated that variations and modifications of the herein described systems and methods, within the scope of the invention will be apparent to those of skill in the art. Accordingly, the foregoing description should be taken as illustrative and not in a limiting sense.

What is claimed is:

1. A directional microphone array comprising:

a plurality of microphone elements arranged along an axis having a proximal end and a distal end, each of said microphone elements having a directional response directed toward said proximal end and parallel to said axis, each of said microphone elements having an output for providing signals responsive to acoustical signals;

said plurality of microphone elements including a primary microphone located closest to said proximal end and at least two secondary microphones each having a respective offset from said primary microphone;

an analog frequency filter connected to said secondary microphones for respectively limiting said output of each of said secondary microphones to a predetermined frequency band having a predetermined relationship to said respective offset and providing frequency filtered outputs respective of said secondary microphones;

an analog summing node, having inputs connected to said frequency filtered outputs, which combines said frequency filtered outputs to form and output a composite second element signal;

an analog-to-digital converter having an input connected to said output of said primary microphone and having an input connected to said output of said summing node which generates a first digital signal representative of said primary microphone output and a second digital signal representative of said composite second element signal; and a signal processor, having an input connected to said analog-to-digital converter, which performs a superdirective analysis of said first and second digital signals forming a superdirective microphone output.

2. A microphone array comprising:

a primary microphone connected to a first analog-to-digital converter;

two or more secondary microphones arranged in line with and spaced a predetermined distance from said primary microphone, each one of said two or more secondary microphones having an analog frequency filtered output having a frequency response limited to a predetermined band of frequencies respective of the relative placement of said one of said two or more secondary microphones; and an output for providing a first analog signal from said primary microphone and a second analog signal from a combination of said frequency filtered outputs of said two or more microphones.

3. The microphone array of claim 2 further comprising:

an analog-to-digital converter, connected to said output, which receives said first and second analog signals and generates a primary microphone signal and a composite secondary microphone signal as a digital output; and a signal processor, connected to said digital output, which receives said primary microphone signal and said composite secondary microphone signals, performs a superdirective analysis of said primary and secondary microphone signals, and outputs an optimized directional microphone output signal.

4. The microphone array of claim 3 wherein said signal processor signal processor further comprises:

a Fast Fourier Transform processor for converting said primary and secondary signals into a plurality of frequency components;

a weight and sum processor which selectively combines selected ones of said frequency components into optimized directional signals; and an inverse FFT processor which generates a microphone output signal.

5. The microphone array of claim 4 further comprising:

a processor for performing at least one of an echo cancellation, noise suppression, automatic gain control, or speech compression processes on said optimized directional signals and providing results of said at least one process to said inverse FFT processor.

6. A telephone conferencing system comprising:

a receiver channel, having an input connected to receive an incoming audio signal and an output, for audibly reproducing said incoming audio signal;

a directional microphone array including a plurality of microphone elements arranged along an axis having a proximal end and a distal end, each of said microphone elements having a directional response directed toward said proximal end and parallel to said axis, each of said microphone elements having an output for providing signals responsive to acoustical signals;

said plurality of microphone elements including a primary microphone located closest to said proximal end and at least two secondary microphones each having a respective offset from said primary microphone;

an analog frequency filter connected to said secondary microphones for respectively limiting said output of each of said secondary microphones to a predetermined frequency band having a predetermined relationship to said respective offset and providing frequency filtered outputs respective of said secondary microphones;

an analog summing node, having inputs connected to said frequency filtered outputs, which combines said frequency filtered outputs to form and output a composite second element signal;

an analog-to-digital converter having an input connected to said output of said primary microphone and having an input connected to said output of said summing node which generates a first digital signal representative of said primary microphone output and a second digital signal representative of said composite second element signal; and a signal processor, having an input connected to said analog-to-digital converter, which performs a superdirective analysis of said first and second digital signals forming a superdirective microphone output; and a transmitter channel, having an input connected to said superdirective microphone output and an output connected to transmit said superdirective microphone output as an outgoing audio signal.

7. The telephone conference system of claim 6 further comprising:

a video pick-up device for sensing visual information;

a video transmission channel having an input connected to said video pick-up device for transmitting an outgoing video signal;

a video receiver channel, having an input connected to receive an incoming video signal.

8. A telephone conferencing system comprising:

a receiver channel, having an input connected to receive an incoming audio signal and an output connected to a speaker system, for audibly reproducing said incoming audio signal;

a multi-directional superdirective microphone array including a plurality of microphone elements each having an output for providing electrical signals responsive to acoustical signals;

said plurality of microphone elements comprising at least two ring microphones arranged a predetermined distance from a centerpoint, each ring microphone having a bidirectional response aligned with a radial axis from said center point and having a respective angular offset;

a filter, having an input connected to said outputs of said plurality of microphone elements, which divides each of said electrical signals into a plurality of frequency components and provides a plurality of frequency band microphone signals respective of each of said microphone elements and of each of said frequency components as an output;

a weighted summing node, having an input connected to said output of said filter, which selectively applies selected coefficients respective of a direction and of said frequency components to said frequency band microphone signals forming weighted frequency band microphone signals and selectively combines selected ones of said weighted frequency band microphone signals into a plurality of band-split directional signals; and an output circuit, connected to said summing circuit, which generates a selected directional microphone signal as an output;

a transmitter channel, having an input connected to said output circuit and an output connected to transmit said superdirective selected directional microphone signal as an outgoing audio signal.

9. The telephone conference system of claim 8 further comprising:

a video pick-up device for sensing visual information;

a video transmission channel, having an input connected to said video pick-up device, for transmitting an outgoing video signal;

a video receiver channel, having an input connected to receive an incoming video signal.

10. A multi-directional superdirective microphone array comprising:

a plurality of microphone elements each having an output for providing electrical signals responsive to acoustical signals;

said plurality of microphone elements comprising at least two ring microphones arranged a predetermined distance from a centerpoint, each ring microphone having a bidirectional response aligned with a radial axis from said center point and having a respective angular offset;

a filter, having an input connected to said outputs of said plurality of microphone elements, which divides each of said electrical signals into a plurality of frequency components and provides a plurality of frequency band microphone signals respective of each of said microphone elements and of each of said frequency components as an output;

a weighted summing node, having an input connected to said output of said filter, which selectively applies selected coefficients respective of a direction and of said frequency components to said frequency band microphone signals forming weighted frequency band microphone signals and selectively combines selected ones of said weighted frequency band microphone signals into a plurality of band-split directional signals; and an output circuit, connected to said summing circuit, which generates a selected directional microphone signal as an output.

11. The microphone array of claim 10 further comprising:

a steering control circuit, having an input connected to said weighted summing node to receive said plurality of band-split directional signals, which selects a direction according to predetermined criteria; and wherein said output circuit generates said selected directional microphone signal in response to selected ones of said plurality of band-split directional signals having a predetermined relationship to said direction.

12. The microphone array of claim 10 further comprising:

a signal enhancing circuit connected to said weighted summing node, wherein said signal enhancing circuit performs at least one of an echo cancellation, noise suppression, automatic gain control, and speech compression processes.

13. The microphone array of claim 10 wherein said output circuit further comprises:

a synthesizer responsive to said selected ones of said plurality of band-split directional signals, and a window circuit connected to said synthesizer.

14. The microphone array of claim 11 further comprising:

an analog-to-digital converter having an input connected to said outputs of said microphone elements and an output, said analog-to-digital converter generating digital signals respective of and representative of each of said electrical signals from each of said plurality of microphone elements;

said filter comprises a digital signal processor performing Fast Fourier Transforms; and said output circuit comprises a digital signal processor performing inverse Fast Fourier Transforms on said selected ones of said plurality of band-split directional signals.

15. The microphone array of claim 10 wherein said plurality of microphone elements further comprises:

at least one axis microphone having a forward response aligned with an axis intersecting said centerpoint and substantially normal to a response plane of said ring microphones;

said axis microphone being arranged a predetermined distance from said centerpoint.

16. The microphone array of claim 11 wherein:

said band-split directional signals comprise signals representative of at least two directions in each of a plurality of bands; and said predetermined criteria comprises selecting a direction whose energy in said plurality of bands is greater than the energy of the remaining directions and is greater than a predetermined threshold for a greater number of said bands than said remaining directions and greater than a predetermined number.

17. The microphone array of claim 16 wherein said predetermined criteria further comprises:

selecting a previous direction when none of said two or more directions exceeds said predetermined number.

18. A microphone array comprising:

a plurality of microphones each having a forward response and a rearward response and an output for providing electrical signals responsive to acoustical signals;

said plurality of microphones comprising inner ring microphones arranged in an inner ring having a first offset from a centerpoint and outer ring microphones arranged in an outer ring having a second offset from said centerpoint;

a frequency filter connected to said plurality of microphones for respectively limiting said output of each of said inner ring microphones to a high frequency band having a predetermined relationship to said first offset and for respectively limiting said output of each of said outer ring microphones to a low frequency band having a predetermined relationship to said second offset;

a plurality of summing nodes having inputs connected to said frequency filter, which selectively combines each of said outputs of said inner ring microphones with a respective one of said outputs of said outer ring microphones to form and output composite microphone ring signals as a summing node output;

a filter, having an input connected to said summing node output, which divides said composite microphone ring signals into a plurality of frequency components and provides a plurality of frequency band microphone signals as an output;

a weighted summing node, having an input connected to said output of said filter, which selectively applies selected coefficients respective of a direction and of said frequency components to said frequency band microphone signals forming weighted frequency band microphone signals and selectively combines selected ones of said weighted frequency band microphone signals into a plurality of band-split directional signals;

a steering control circuit, having an input connected to said weighted summing node to receive said plurality of band-split directional signals, which steering control circuit selects a direction according to predetermined criteria; and an output circuit which generates a selected directional microphone signal in response to selected ones of said plurality of band-split directional signals having a predetermined relationship to said direction.

19. A method of operating a microphone array comprising the steps of:

receiving microphone signals representative of a plurality of spaced apart microphones;

frequency filtering said microphone signals to produce a plurality of narrow band signals respective of each one of said plurality of spaced apart microphones;

weighting and summing said plurality of narrow band signals to form a plurality of narrow band directional signals respective of two or more directions;

evaluating the energy of said narrow band directional signals and selecting an output direction from said two or more directions according to predetermined criteria; and converting selected ones of said narrow band directional signals respective of said output direction into a full band directional output.

20. The method of claim 19 further comprising the steps of:

performing at least one process for echo cancellation, noise suppression, automatic gain control, or speech compression using said selected ones of said narrow band directional signals.

21. A method of operating a superdirective array comprising the steps of:

providing a primary pickup element having an output;

providing a plurality of secondary pickup elements each having an output and each spaced a respective distance from said primary pickup element;

frequency filtering said outputs of said secondary pickup elements to respectively limit the frequency response of each of said secondary pickup elements to a frequency range respective said respective distance;

combining said frequency filtered outputs of said secondary pickup elements into a composite secondary output; and performing a superdirective analysis of said primary and said composite secondary outputs to form an optimized array output.

22. A signal processor apparatus for operating a microphone array comprising:

an input for receiving microphone signals from a plurality of spaced apart microphones;

a frequency filter, connected to said input to receive said microphone signals, which filter produces a plurality of narrow band signals respective of each one of said plurality of spaced apart microphones as an output;

a weighting and summing processor, having an input connected to said frequency filter output, which receives said plurality of narrow band signals and forms a plurality of narrow band directional signals respective of two or more directions as an output;

a steering processor, having an input connected to said weighting and summing processor, which receives and evaluates the energy of said narrow band directional signals and selects an output direction from said two or more directions according to predetermined criteria; and an output processor, having an input connected to receive selected ones of said narrow band directional signals respective of said output direction, which generates a full band directional output.

23. The signal processor of claim 22 further comprising:

a signal enhancer, having an input connected to receive said selected ones of said narrow band directional signals and having an output connected to said input of said output processor, said signal enhancer performing at least one process for echo cancellation, noise suppression, automatic gain control, or speech compression.

24. The signal processor of claim 22 wherein said predetermined criteria comprises:

determining the direction whose energy in said bands is both greater than the energy of the remaining directions and greater than a predetermined threshold for a greater number of said bands than said remaining directions and said number of said bands is greater than a predetermined number.

25. The signal processor of claim 24 wherein said predetermined criteria further comprises:

selecting a previous direction when none of said two or more directions exceeds said predetermined number.

* * * * *